US009607796B2

(12) United States Patent
Liang et al.

(10) Patent No.: US 9,607,796 B2
(45) Date of Patent: Mar. 28, 2017

(54) ELECTROMAGNETIC STRUCTURE COMPRISING A PERMANENT MAGNET

(71) Applicant: Harbin Institute Of Technology, Habin, Heilongjiang Province (CN)

(72) Inventors: Huimin Liang, Harbin (CN); Yong Xie, Guilin (CN); Jiaxin You, Harbin (CN); Guoqiang Xie, Guilin (CN)

(73) Assignee: HARBIN INSTITUTE OF TECHNOLOGY, Harbin, Heilongjiang (CN)

( * ) Notice: Subject to any disclaimer, the term of this patent is extended or adjusted under 35 U.S.C. 154(b) by 0 days.

(21) Appl. No.: 14/758,647

(22) PCT Filed: Sep. 16, 2014

(86) PCT No.: PCT/CN2014/000845
§ 371 (c)(1),
(2) Date: Jun. 30, 2015

(87) PCT Pub. No.: WO2015/043109
PCT Pub. Date: Apr. 2, 2015

(65) Prior Publication Data

US 2016/0172137 A1 Jun. 16, 2016

(30) Foreign Application Priority Data

Sep. 27, 2013 (CN) ..... 2013 1 0449443

(51) Int. Cl.
*H01H 50/36* (2006.01)
*H01H 50/16* (2006.01)
(Continued)

(52) U.S. Cl.
CPC ..... *H01H 50/36* (2013.01); *H01F 1/057* (2013.01); *H01F 7/081* (2013.01); *H01H 50/16* (2013.01);
(Continued)

(58) Field of Classification Search
CPC ..... H01H 50/16; H01H 50/42; H01H 50/18; H01H 50/36; H01F 1/057; H01F 7/081; H01F 2007/083
See application file for complete search history.

(56) References Cited

U.S. PATENT DOCUMENTS 4,774,485 A 9/1988 Dietrich

FOREIGN PATENT DOCUMENTS

CN 201387783 Y 1/2010
CN 102956397 A 3/2013
(Continued)

OTHER PUBLICATIONS

Search Report dated Sep. 27, 2013 issued in corresponding CN 2013104494434 application (pp. 1-2).
(Continued)

*Primary Examiner* — Bernard Rojas
(74) *Attorney, Agent, or Firm* — Millen, White, Zelano & Branigan, P.C.; William Nixon

(57) ABSTRACT

An electromagnetic structure comprising permanent magnets comprises an outer yoke (a6), a first permanent magnet group (a3, a5), an inner yoke (a8), an armature (a1), and a second permanent magnet group (a2, a4). The outer yoke is in a hollow cylinder shape. The first permanent magnet group comprises multiple permanent magnets arrayed in a round shape, the multiple permanent magnets are connected to the outer yoke, and a magnetizing direction of each permanent magnet is along an axial direction. The inner yoke comprises an inner yoke upper base, an inner yoke sidewall, and an inner yoke lower base. The inner yoke upper base and the inner yoke lower base are separately extended outwards and horizontally from an upper end and a lower end of the inner yoke sidewall to form a circular ring. The armature comprises an armature upper base, an
(Continued)

armature lower base, and an armature barrel body. The armature barrel body penetrates through the inner yoke sidewall, and the height of the armature barrel body is greater than that of the inner yoke. The armature upper base and the armature lower base are separately in a round shape with a diameter greater than an inner diameter of the inner yoke sidewall. The second permanent magnet group comprises multiple permanent magnets arrayed in a round shape, the multiple permanent magnets are connected to the outer yoke and the inner yoke, and a magnetizing direction of each permanent magnet is along an axial direction. The electromagnetic structure is low in power consumption of a coil, has a good shock resistance performance, and has a good capability against the centrifugal acceleration impact.

3 Claims, 4 Drawing Sheets

(51) Int. Cl.

| | |
|---|---|
| ***H01F 1/057*** | (2006.01) |
| ***H01F 7/08*** | (2006.01) |
| ***H01H 50/18*** | (2006.01) |
| ***H01H 50/42*** | (2006.01) |

(52) U.S. Cl.
CPC ..... *H01H 50/18* (2013.01); *H01H 50/42* (2013.01); *H01F 2007/083* (2013.01)

(56) References Cited

FOREIGN PATENT DOCUMENTS

| | | | |
|---|---|---|---|
| CN | 103295843 | A | 9/2013 |
| CN | 103500688 | A | 1/2014 |
| DE | 3635431 | C1 | 1/1988 |
| JP | 64-82607 | A | 3/1989 |
| JP | 2007-59843 | A | 3/2007 |
| JP | 2008-66602 | A | 3/2008 |

OTHER PUBLICATIONS

English Abstract of JP 64-082607 A published Mar. 28, 1989.
English Abstract of CN 201387783 Y published Jan. 20, 2010.
International Search Report dated Dec. 9, 2014 issued in PCT/CN2014/000845 application (pp. 1-2).
English Translation Abstract of JP 2007-059843 published Mar. 8, 2007.
English Translation Abstract of JP 2008-066602 published Mar. 21, 2008.
English Translation Abstract of CN 102956397 published Mar. 6, 2013.
English Translation Abstract of CN 103295843 published Sep. 11, 2013.
English Translation Abstract of CN 103500688 published Jan. 8, 2014.

ELECTROMAGNETIC STRUCTURE COMPRISING A PERMANENT MAGNET

TECHNICAL FIELD

The present invention relates to a technical field of a relay, in particular, to an electromagnetic structure containing a permanent magnet, which is applied in varieties of electromagnetic systems such as a relay and so on.

BACKGROUND

The relay containing a permanent magnet could be classified by motion modes of armatures, which could be divided into a rotating armature, a direct-acting armature, and so on. Wherein, a direct-acting relay (the relay with a direct-acting armature) is a very important class of relays. In addition, it has the features such as a simple structure, a broad application, and a stable performance. In particular, the direct-acting relay is widely used in aerospace, defense and civilian fields. In a direct-acting relay containing a permanent magnet, the permanent magnet provides the retention force in a stable state, the armature is the device to undertake a switching operation, and the yoke is the device to limit displacement of the armature. Based on the permanent magnet, the armature, and the yoke as a center, the entire relay magnetic circuit consisted of a connecting coil core, a magnetic permeable ring and other devices, directly determines the overall performance of the relay containing a permanent magnet.

Therefore, it becomes a demanding problem to be solved for those skilled in the art how to design an electromagnetic structure having a highly efficient magnetic flux confinement, bistable magnetic latching, low energy consumption of the coil, and a simple structure.

SUMMARY OF THE INVENTION

The object of the present invention is to provide an electromagnetic structure design, having a highly efficient magnetic flux confinement, bistable magnetic latching, low energy consumption of the coil, and a simple structure, so as to assemble actual products more efficiently, improve homogeneity of the same product batch, and reduce a rejection rate of a product batch.

In order to achieve the above object, the present invention provides an electromagnetic structure containing a permanent magnet, which comprises:

An outer yoke, which is hollow cylindrical, and is composed of an upper base of the outer yoke, a lower base of the outer yoke, and an outer yoke sidewall;

A first permanent magnet group, comprising a plurality of permanent magnets arranged in a circular shape, wherein, the plurality of permanent magnets in the first permanent magnet group are connected to the lower base of the out yoke, and a magnetization direction of each permanent magnet is along an axial direction of the permanent magnet;

An inner yoke, comprising an upper base of the inner yoke, a lower base of the inner yoke, and an inner yoke sidewall, wherein, the inner yoke sidewall is cylindrical, and the upper base of the inner yoke is a circular ring formed by extending outwardly and horizontally from an upper end of the inner yoke sidewall, and the lower base of the inner yoke is a circular ring formed by extending outwardly and horizontally from a lower end of the inner yoke sidewall; and the lower base of the inner yoke is connected to the first permanent magnet group;

An armature, comprising an upper base of the armature, the a lower base of the armature, and a cylindrical body of the armature; the cylindrical body of the armature passes through a centre of a through-hole of the inner yoke, and the height of the cylindrical body of the armature is greater than the height of the inner yoke; and the upper base of the armature and the lower base of the armature are circles either having a diameter greater than the inner diameter of the inner yoke sidewall;

A second permanent magnet group, comprising a plurality of permanent magnets arranged in a circular shape, wherein, the plurality of permanent magnets in the second permanent magnet group are connected to the upper base of the out yoke and the upper base of the inner yoke, and a magnetization direction of each permanent magnet is along an axial direction of the permanent magnet;

The electromagnetic structure containing a permanent magnet is provided according to the present invention, wherein, which further comprising a connecting rod, and the one end of the connecting rod is fixedly connected to the centre of the armature, and the other end of the connecting rod goes through the outer yoke and extends from the outer yoke.

The electromagnetic structure containing a permanent magnet is provided according to the present invention, wherein, the plurality of permanent magnets in the first and the second permanent magnet groups are cylindrical permanent magnets.

The electromagnetic structure containing a permanent magnet is provided according to the present invention, wherein, the material of the permanent magnet is NdFeB, AlNiCo or ferrite.

The present invention is suitable for applying in direct-acting electromagnetic systems such as relays, contactors, circuit breakers, solenoid valves, magnetic switches and other devices. Compared with the prior art, the present invention has a symmetrical structure, versatile components, a simple assembly process; and the present invention has features such as bistable magnetic latching, adjusting and latching a force of the permanent magnets, and flexibly configuring. Further, after the present invention is applied in a certain electromagnetic system, it is more convenient to change the force by simply replacing the permanent magnet (within the magnetic saturation range). Moreover, it takes a lower condition to trigger and touch the permanent magnet. It only requires a short-time pulse for a process of closing (or opening) the permanent magnet. It reduces power consumption of the coil. The present invention also has a good performance of anti-vibration, and a very strong capability of anti-impact from a centrifugal acceleration speed.

DETAILED DESCRIPTION OF THE EMBODIMENTS

With reference to the accompanying drawings illustrating the embodiments of the present invention, the technical solutions of the embodiments of the present invention are described clearly and integrally therein. The described embodiments are only a part of the embodiments of the present invention, but not all of the embodiments of the present invention. Based on the embodiments of the present invention, any other embodiment obtained by those skilled in the art without devoting creative work, should be deemed to fall within the protection scope of the present invention.

Figure 1:
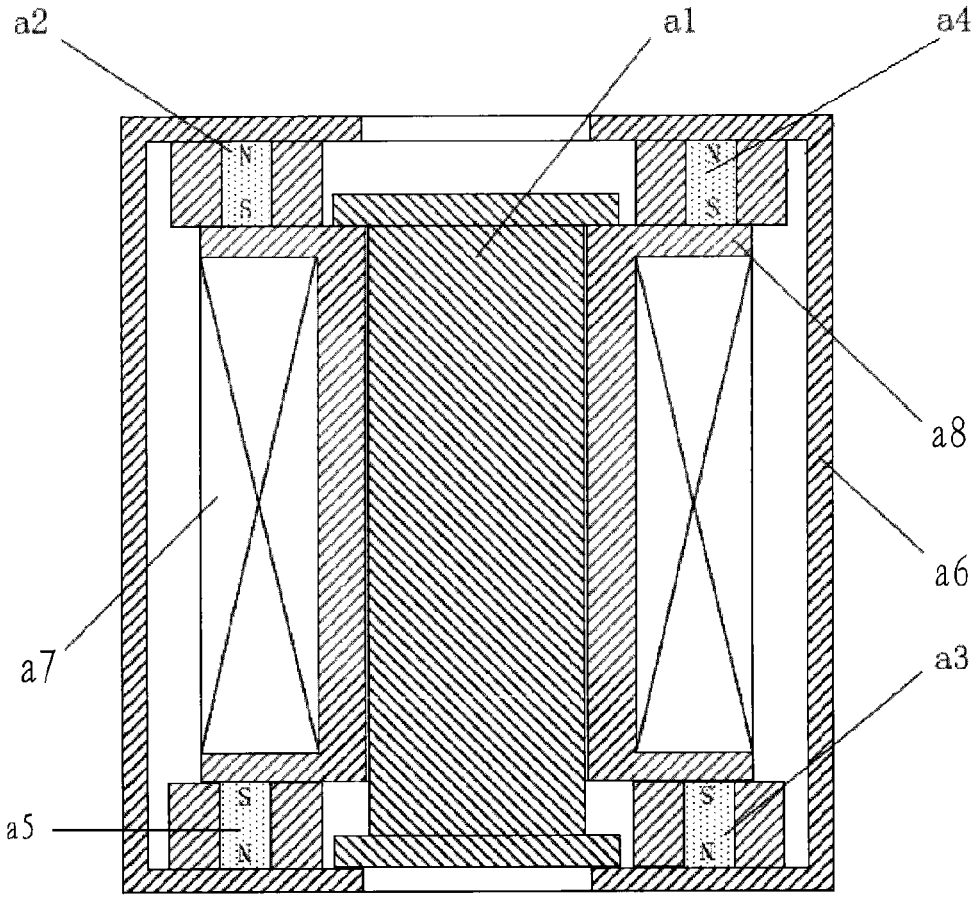
FIG. 1 is a schematic diagram of a basic structure of the present invention.

Please refer to FIG. 1, there are an armature a1, permanent magnets a2, a3, a4, a5, an outer yoke a6; a coil a7, an inner yoke a8 and so on in a specific structure of the present invention. Wherein, the material of the armature a1, the material of the outer yoke a6 and the material of the inner yoke a8 are all high magnetic permeability materials. At the same time, the outer yoke a6 is an overall housing of the present invention, which is applying for protecting an internal structure of the present invention; and, at the same time, the inner yoke a8 also serves as a coil bobbin for the coil a7 to wound on.

Figure 2:
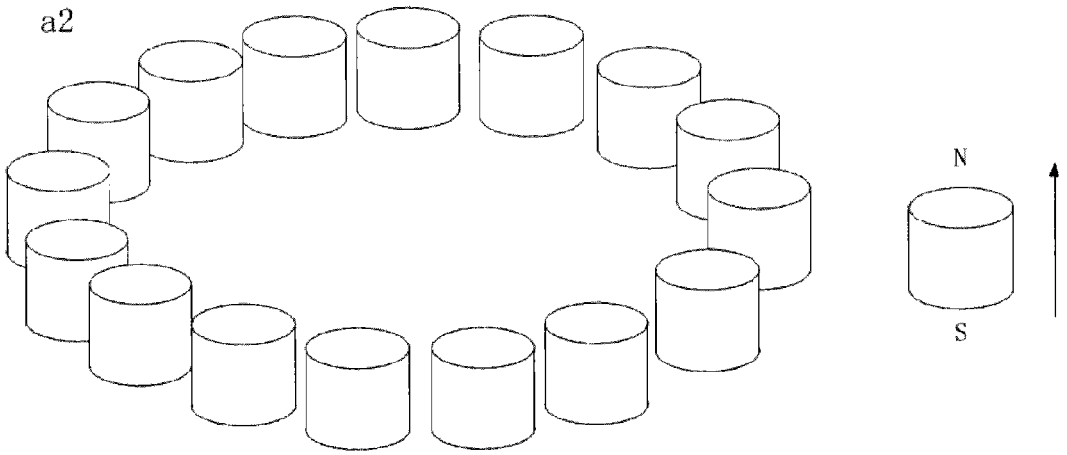
FIG. 2 is a schematic diagram of a layout of groups of the permanent magnets of the present invention.

The permanent magnets of the present invention contain two permanent magnet groups actually, which are respectively located on a upper pole surface and a lower pole surface of the outer yoke a6, and either permanent magnet group comprises a plurality of permanent magnets arranged in a circular shape (As shown in FIG. 2), and reference signs a2, a3, a4 and a5 displayed in FIG. 1 are four permanent magnets along the longitudinal cross-sections by a lucky coincidence. Wherein each permanent magnet is cylindrical, and a magnetization direction of each permanent magnet is the vertical direction, i.e. an up and down direction, and the selected material of each permanent magnet can be changed as NdFeB, AlNiCo or ferrite and another material depending on the design requirements, so as to provide a holding force for holding ends of the armature in effect.

The design of longitudinal cross-section structure of the inner yoke a8 in the present invention is a couple of C-shaped forms, and has two pole surfaces such as an upper pole surface and a lower pole surface. A center shaft of the whole magnetic circuit of the inner yoke a8 is configured as a symmetry axis, and the inner yoke a8 also has a function as a coil bobbin. When the armature a1 is at an upper end position, an upper surface of the upper pole surface of the armature a1 is in contact with a lower surface of the upper pole surface of the outer yoke a6. When the armature a1 is at a lower end position, a lower surface of the lower pole surface of the armature a1 is in contact with an upper surface of the lower pole surface of the outer yoke a6. The coil a7 is enwound on the inner yoke a8. A relative position of a connecting rod (not shown on the FIG.) and the armature a1 is fixed. And the end portions can be connected to a main contact, when the armature a1 take actions, so as to achieve signal switching.

When the coil is power-off, a permanent magnetic field generated by the permanent magnets group may result an attraction force between the pole surfaces of the outer yoke a6 and the pole surfaces of the inner yoke a8, and the armature a1 is fixed at the lower end position (or the upper end position). When the coil is power-on, the permanent magnetic field of the permanent magnet group is counteracted by the electromagnetic field generated by the coil, a flux of the permanent magnetic field may result an attraction force between the upper pole surface of the outer yoke a6 and the armature a1, and the armature a1 would be moving until it contacts with the upper pole surface of the outer yoke a6, the armature a1 drives the connecting rod on the armature a1 to complete an direct-acting movement of the magnetic circuit system, and then to complete switching on or off states of the electromagnetic equipments of the magnetic circuit system.

Figure 3:
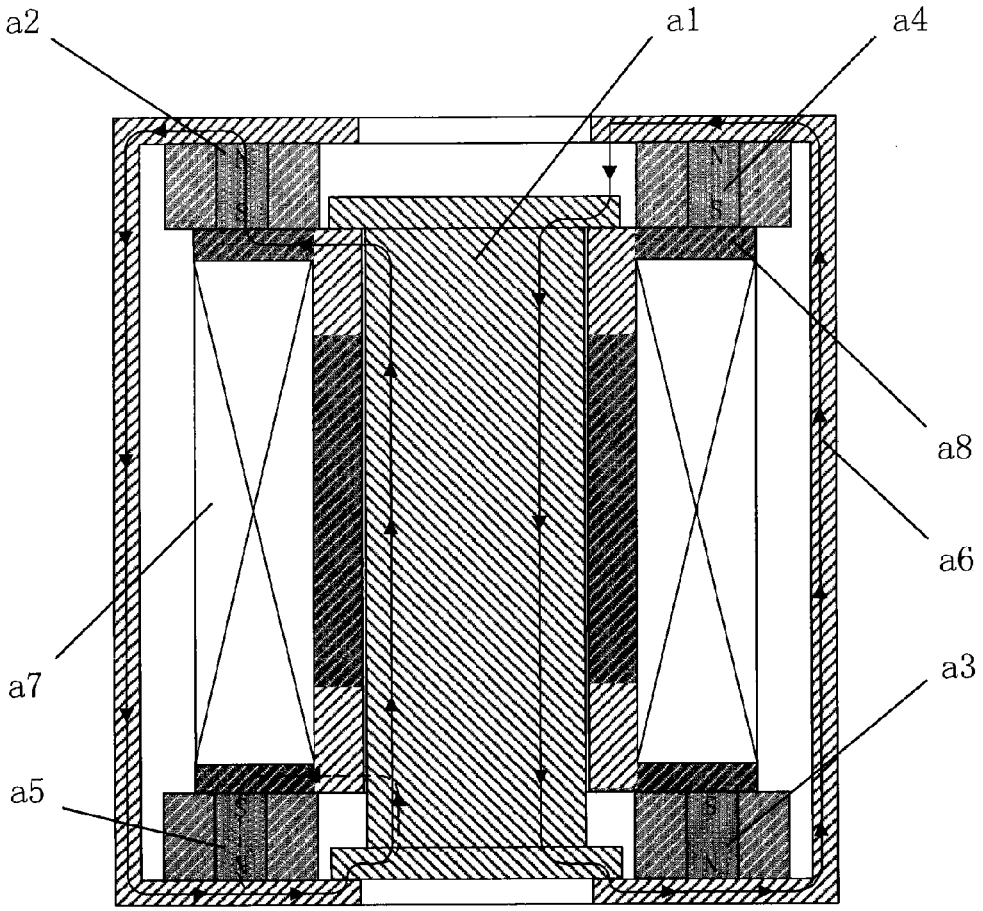
FIG. 3 is a schematic diagram of a magnetic circuit at a broken or open position of the present invention.

A detailed operating process of the present invention is as follows:

The armature a1 is initially at the lower end position, and the armature a1 is in contact with the upper surface of the lower pole surface of the outer yoke a6; the coil is enwound on the inner yoke a8. At this moment, the magnetic circuit flux with not any coil current possesses two closed paths (as shown in FIG. 3. FIG. 3 only illustrates the left flux path. And the right flux path is centrally symmetry with the left flux path): wherein, a path 1 (macro ring) is as follows: the center of the armature a1—the upper pole surface of the inner yoke (coil bobbin) a8—permanent magnet a2—outer yoke (housing) a6—the lower surface of the lower pole surface of the armature a1—the center of the armature a1. A path 2 (small ring) is as follows: armature a1—the lower pole surface of the inner yoke (coil bobbin) a8—permanent magnet a5—outer yoke (housing) a6—the lower surface of the lower pole surface of the armature a1. Under the action of the closed magnetic flux circuit, the armature a1 remains at the initial lower end position by the attraction force between the pole surfaces.

When the coil is power-on, the magnetic flux generated by the coil is shown in the right side of a magnetic circuit of FIG. 3. And flux path of the magnetic circuit flux of the coil is as follows: the center of the armature a1—the upper pole surface of the outer yoke (housing) a6—the outer yoke (housing) a6—the lower pole surface of the outer yoke (housing) a6—the lower surface of the lower pole surface of the armature a1—the center of the armature a1. That is, the coil generates a flux is reversed to the flux of the permanent magnet, so as to weaken the flux of the permanent magnet in the armature a1, until reduce it to 0. Later, with increases of electromagnetism flux, the flux between the upper pole surface of the outer yoke (housing) a6 and the upper surface of the upper pole surface of the armature a1 increases, and generated electromagnetic attraction force increases, and then the armature a1 actions and upwardly moves, until an end of the upper pole surface of the armature a1 contacts with the upper pole surface of the outer yoke a6, and drives the connecting rod to complete switching on or off the relay.

Figure 4:
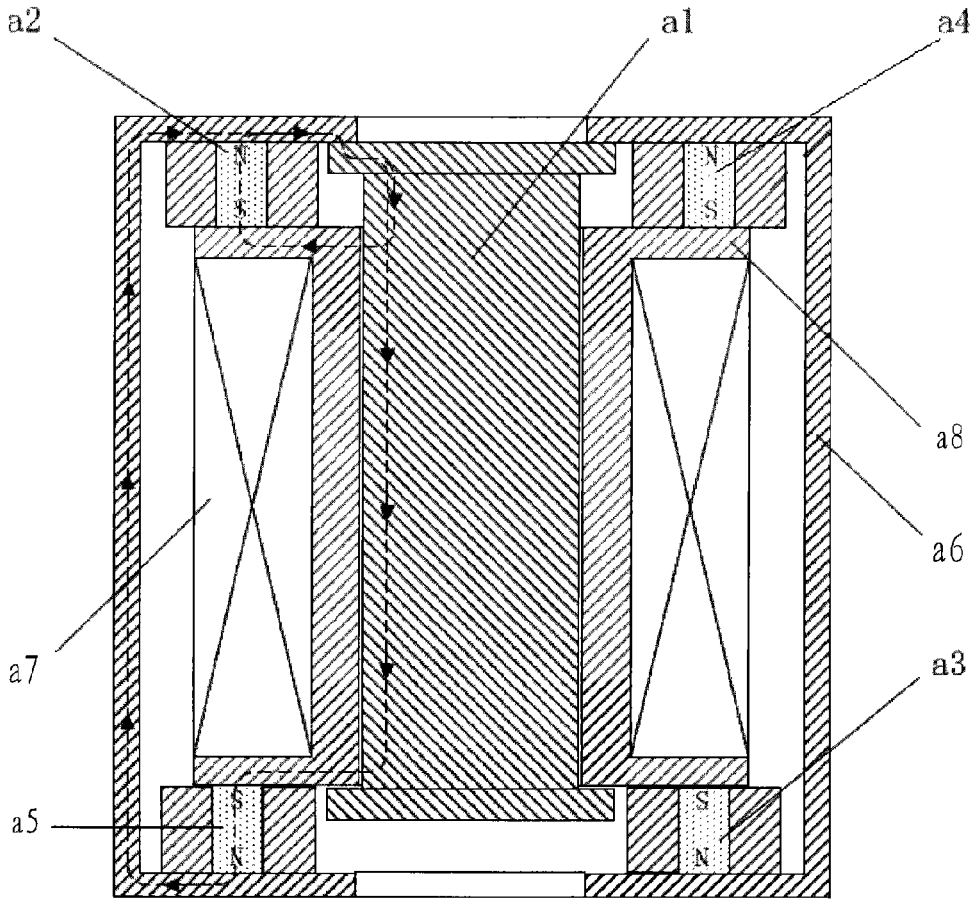
FIG. 4 is a schematic diagram of a magnetic circuit at a conducted or closed position of the present invention Reference signs: a1—armature; a2, a3, a4, a5—permanent magnets; a6—outer yoke; a7—coil; a8—inner yoke.

When the coil keeps power-on, the armature a1 is at the upper end position, and the armature a1 is in contact with the upper pole surface of the outer yoke a6; the coil is wound on coil bobbin a7. At this moment, the magnetic circuit flux with a coil current possesses two closed paths (as shown in FIG. 4. FIG. 4 only illustrates the left flux path. And the right flux path is centrally symmetry with the left flux path): wherein, a path 1 (macro ring) is as follows: the center of the armature a1—the upper pole surface of inner yoke (coil bobbin) a8—permanent magnet a5—outer yoke (housing) a6—the upper surface of the upper pole surface of the armature a1—the center of the armature a1. A path 2 (small ring) is as follows: armature a1—inner yoke (coil bobbin) a8—permanent magnet a2—the upper pole surface of the outer yoke (housing) a6—the upper surface of the upper pole surface of the armature a1—armature a1. Under the action of the closed magnetic flux circuit, the armature a1 remain at the upper end position by the attraction force between the pole surfaces. A reverse current is necessary to pass through the coil, if the armature is intended to be returned to the position shown in FIG. 3.

By these above actions, the present invention can implement the corresponding functions of the action piece of the direct-acting electromagnetic system (such as the armature in the relay).

In summary, the present invention is suitable for applying in direct-acting electromagnetic systems such as relays, contactors, circuit breakers, solenoid valves, magnetic switches and other devices. Compared with the prior art, the present invention has a symmetrical structure, versatile components, a simple assembly process; and the present invention has features such as bistable magnetic latching, adjusting and latching a force of the permanent magnets, and flexibly configuring. Further, after the present invention is applied in a certain electromagnetic system, it is more convenient to change the force by simply replacing the permanent magnet (within the magnetic saturation range). Moreover, it takes a lower condition to trigger and touch the permanent magnet. It only requires a short-time pulse for a process of closing (or opening) the permanent magnet. It reduces power consumption of the coil. The present invention also has a good performance of anti-vibration, and a very strong capability of anti-impact from a centrifugal acceleration speed.

The above description to the present invention is intended to be illustrative, but not to be restrictive. As will be appreciated by those skilled in the art, within the spirit and scope defined in the claims, any modification, equivalent replacement, improvement, and so on of the present invention will fall within the scope of the present invention.

What is claimed is:

1. An electromagnetic structure containing a permanent magnet, comprising:

an outer yoke, which is hollow cylindrical, and is composed of an upper base of the outer yoke, a lower base of the outer yoke, and an outer yoke sidewall;

a first permanent magnet group, comprising a plurality of permanent magnets arranged in a circular shape, wherein, the plurality of permanent magnets in the first permanent magnet group are connected to the lower base of the out yoke, and a magnetization direction of each permanent magnet is along an axial direction of the permanent magnet;

an inner yoke, comprising an upper base of the inner yoke, a lower base of the inner yoke, and an inner yoke sidewall, wherein, the inner yoke sidewall is cylindrical, and the upper base of the inner yoke is a circular ring formed by extending outwardly and horizontally from an upper end of the inner yoke sidewall, and the lower base of the inner yoke is a circular ring formed by extending outwardly and horizontally from a lower end of the inner yoke sidewall; and the lower base of the inner yoke is connected to the first permanent magnet group;

an armature, comprising an upper base of the armature, a lower base of the armature, and a cylindrical body of the armature; wherein, the cylindrical body of the armature passes through a centre of a through-hole of the inner yoke, and the height of the cylindrical body of the armature is greater than the height of the inner yoke; and the upper base of the armature and the lower base of the armature are circles either having a diameter greater than the inner diameter of the inner yoke sidewall; and a second permanent magnet group, comprising a plurality of permanent magnets arranged in a circular shape, wherein, the plurality of permanent magnets in the second permanent magnet group are connected to the upper base of the out yoke and the upper base of the inner yoke, and a magnetization direction of each permanent magnet is along an axial direction of the permanent magnet.

2. The electromagnetic structure containing a permanent magnet as claimed in claim 1, wherein, the plurality of permanent magnets in the first and the second permanent magnet groups are cylindrical permanent magnets.

3. The electromagnetic structure containing a permanent magnet as claimed in claim 1, wherein, the material of the permanent magnet is NdFeB, AlNiCo or ferrite.

* * * * *